United States Patent [19]

Hartnig

[11] Patent Number: 4,667,690

[45] Date of Patent: May 26, 1987

[54] BOTTLE WASHING APPARATUS

[75] Inventor: Heinz Hartnig, Oberurnen, Switzerland

[73] Assignee: Inmarco AG, Oberurnen, Switzerland

[21] Appl. No.: 570,904

[22] Filed: Jan. 16, 1984

[30] Foreign Application Priority Data

Jan. 19, 1983 [DE] Fed. Rep. of Germany ..... 3301525

[51] Int. Cl.[4] ..... B08B 9/08

[52] U.S. Cl. ..... 134/62; 134/66; 134/129; 134/167 R; 134/144; 239/264; 239/225.1

[58] Field of Search ..... 134/61, 67, 70, 127, 134/129, 133, 134, 144, 62, 68, 69, 131, 152, 167 R, 172, 66; 239/225, 264; 118/317

[56] References Cited

U.S. PATENT DOCUMENTS

| | | | |
|---|---|---|---|
| 1,181,913 | 5/1916 | Miller | 134/129 |
| 1,466,141 | 8/1923 | Miller | 134/129 |
| 1,592,452 | 7/1926 | Ferris et al. | 239/225 X |
| 1,740,186 | 12/1929 | Lippold | 134/62 |
| 2,003,778 | 6/1935 | Willis | 239/225 X |
| 2,184,100 | 12/1939 | Mondloch | 134/66 X |
| 2,263,627 | 11/1941 | Herold | 134/144 X |
| 2,634,737 | 4/1953 | Rowe | 134/129 X |
| 2,710,819 | 6/1955 | Weber et al. | 134/131 |
| 3,043,318 | 7/1962 | Hi | 134/129 X |
| 3,563,256 | 2/1971 | Babunovic | 134/129 X |
| 3,583,544 | 6/1971 | Prodzenski | 134/68 X |
| 3,677,273 | 7/1972 | Mahlstede et al. | 134/127 |
| 4,080,974 | 3/1978 | Oag | 134/70 X |
| 4,102,351 | 7/1978 | Weindahl et al. | 134/129 |
| 4,165,756 | 8/1979 | Sirch et al. | 134/133 X |
| 4,423,745 | 1/1984 | Butt et al. | 134/62 |

FOREIGN PATENT DOCUMENTS

| | | | |
|---|---|---|---|
| 2156543 | 6/1973 | Fed. Rep. of Germany | 134/62 |

*Primary Examiner*—Harvey C. Hornsby
*Assistant Examiner*—Frankie L. Stinson
*Attorney, Agent, or Firm*—Tarolli, Sundheim & Covell

[57] ABSTRACT

The invention relates to a washing apparatus, especially to an apparatus for rinsing of glass bottles before first filling.

The bottles to be rinsed are fed to the apparatus by means of a conveyor installation. The incoming bottles are picked up by a receiving means including a conveyor, the runway of which extending in a vertical plane. The bottles are transferred to a transportation device whereby the bottles are pivoted about 180 degrees. The transportation device includes a conveyor advancing said bottles to a rinsing station having a rinsing device and to a draining station. A removing device pick-up the clean bottles from the transportation device and transfers the bottles to a further conveying installation for discharging the bottles from the apparatus. During transferring the bottles are pivoted about 180 degrees such that upright bottles ready for filling are outputted from the apparatus.

By such an arrangement of the receiving means, the removing means and the transportation device, the system may have smallest overall dimensions.

8 Claims, 6 Drawing Figures

BOTTLE WASHING APPARATUS

BACKGROUND OF THE INVENTION

1. Field of the Invention

The present invention relates to an improved bottle washing apparatus and particularly to an apparatus for washing glass bottles prior to filling them with the fluid content they are intended to receive. Newly manufactured glass bottles usually contain residues from manufacturing as well as contaminations, e.g. packaging material, broken glass, dust, vermin etc. which deposite in the bottle during transportation and storage thereof. Therefore it is of paramount importance to thoroughly clean these bottles before filling them. For that purpose washing plants or so-called bottle-rinsers are used. The use of washing plants comprising a plurality of basic washing pools has the disadvantage of involving high costs in washing newly manufactured bottles, i.e. not recirculated bottles, because invenstments as well as labour costs resulting from power consumption and water consumption are very high.

2. Prior Art

In order to avoid these disadvantages it has been proposed to use a washing apparatus of similar construction as hereinbefore described but which is provided, as far as the cleaning station is concerned, with fresh water spraying devices instead of basic liquid pools. However a drawback of such apparatus is that it's construction is similarly expensive as that of the washing plants mentioned above. Furthermore a common characteristic of the above mentioned plants is that they have to be loaded batchwise, therefore calling for storage means in front of and after the plant. Such batchwise feeding means and unloading means are subject to troubles and usually ask for a person to watch upon there regular operation. Finally if such plants have to be changed to operate with another bottle size a considerable amount of spare parts and time is necessary.

In the prior art a further kind of washing apparatus for bottles is disclosed, picking up bottles to be washed which are fed in one line, continously inversing these bottles by means of a pivotable mechanism such that the bottle mouth is directed downwardly and forwarding the bottles in such inversed position to a stationary mounted spraying nozzle arrangement. The washing liquid having been drained from the bottle after the washing process, the bottles are inversed again and put on a discharge conveyor in the original position. Such washing plants have the disadvantage that the cleaning of the bottles is incomplete as only a fraction of the washing liquid gets into the bottle to be cleaned, the water consumption thereby being very high.

Another kind of washing up apparatus disclosed in the prior art comprise a feeding means including a sorting means to feed the incoming bottles to be washed in one line by a vertically disposed chain conveyer. The conveyor chain thereof is equipped with a plurality of bottle receiving means consisting of a plate-like member to receive the base part of the bottles, as well as of an annular part which is slipped over the neck of the bottle when the latter is handed over by the sorting means.

Finally, French Patent Publication Nr. 7805458 discloses a washing apparatus in which incoming bottles are isolated from each other by a continuously moving lifting apparatus to be gripped in the region of their neck by gripping means. The gripping means are received on a conveyor chain which is circulated around a wheel rotatable about a horizontal axis. During the washing process the bottles are sprayes out by synchronously driven spraying nozzles. Now the bottles remain positioned with their mouth directed downwardly during a certain period in order to allow the washing liquid to drain, and subsequently the bottles are inversed again to their original position, i.e. with their bottom directed downwardly. Finally the washed bottles are removed from the washing apparatus and fed to a conveyor by means of a discharging means or by a rotatably mounted lowering installation.

All the installations and plants of the prior art discussed above have common disavantages: Due to the fact that the transporting means, realized by chain conveyors, are arranged in a vertical plane, only one single length of the conveying path may be used for rinsing the bottles; this conveying path usually is smaller than a quarter of the circumference of the driving wheel. In addition such systems have a considerable total height because the bottles to be washed are fed in upright horizontal alignment and thereafter inversed about a horizontal axis in the region of their bottom. Finally it must be mentioned that the washed bottles may be drained only along the horizontally extending part of the chain conveyor; therefor such plants of the kind as described above require considerable space in their longitudinal direction.

OBJECTS OF THE INVENTION

Hence it is a general object of the present invention to provide an improved bottle washing apparatus which avoids the drawbacks discussed hereinbefore and which allows to efficiently wash newly manufacuted bottles prior to filling them with the liquid content they are intended for. A further object of the invention is to provide a bottle washing apparatus having short overall dimensions, nevertheless warranting an efficient washing of the bottles in as short a time, or in an even shorter time, as provided by the apparatus according to the prior art.

SUMMARY OF THE INVENTION

The present invention provides an improved apparatus for the cleaning of containers which are open on one side, particularly for the washing or rinsing of glass bottles. The apparatus comprises first conveying means for continuously feeding containers to be washed or rinsed in one continuous straight line, first handling means for continuously taking off said containers fed by said first conveying means and putting them onto a continuously running transportation means which conveys the containers to at least one cleaning station and to at least one draining station. Further, there are provided second handling means for continuously taking off the cleaned containers from said transportation means and second conveying means for continuously removing said cleaned containers out of the apparatus.

Said first and second handling means each include endless conveyors the runway thereof being disposed in a common or in two separate, substantially vertical planes, while said transportation means includes an endless conveyor, the runway thereof being disposed in a substantially horizontal plane. Said horizontal plane of the runway of the transportation means and said vertical plane or planes, respectively, intersect in straight lines which substantially concide with at least a part of the runway of the conveyor of said transportation means or are disposed in a parallel relationship thereto.

The runway of the conveyor of said transportation means comprises two semicircles and two straight lines. The conveyors of the first and the second handling means are disposed, relative to the transportation means, such that planes defined by their runways intersect with the plane of the transportation conveyor in a straight line coincident with one of the straight line portions of the runway of the conveyor of the transportation means.

Each bottle is rinsed by means of a rinsing device having a plurality of spraying nozzles located in circular arrangement. The rinsing device is located underneath the transportation means and is driven synchronously with the conveyor thereof. This allows the rinsing of the bottles during passage along the semicircle of the runway of the transportation conveyor because one bottle and one spraying nozzle always are in alignment to each other.

The rinsing device includes a circular plate member and a plurality of rotatably mounted discs each provided with one spraying nozzle, the nozzle duct thereof being inclined with regard to the axis of rotation of the spraying nozzle. The rotatable discs are surrounded by a belt, the ends thereof being fixedly mounted to the machine frame in order to rotate the discs during rotation of the plate member. This eliminates the danger that the bottles are only partly rinsed because the main jet of rinsing fluid sweeps over the entire inner surface of the bottle.

BRIEF DESCRIPTION OF THE DRAWINGS

The present invention will be more fully understood by reference to the following detailed description thereof when read in conjunction with the attached drawings and where.

DESCRIPTION OF A PREFERRED EMBODIMENT

Figure 1:
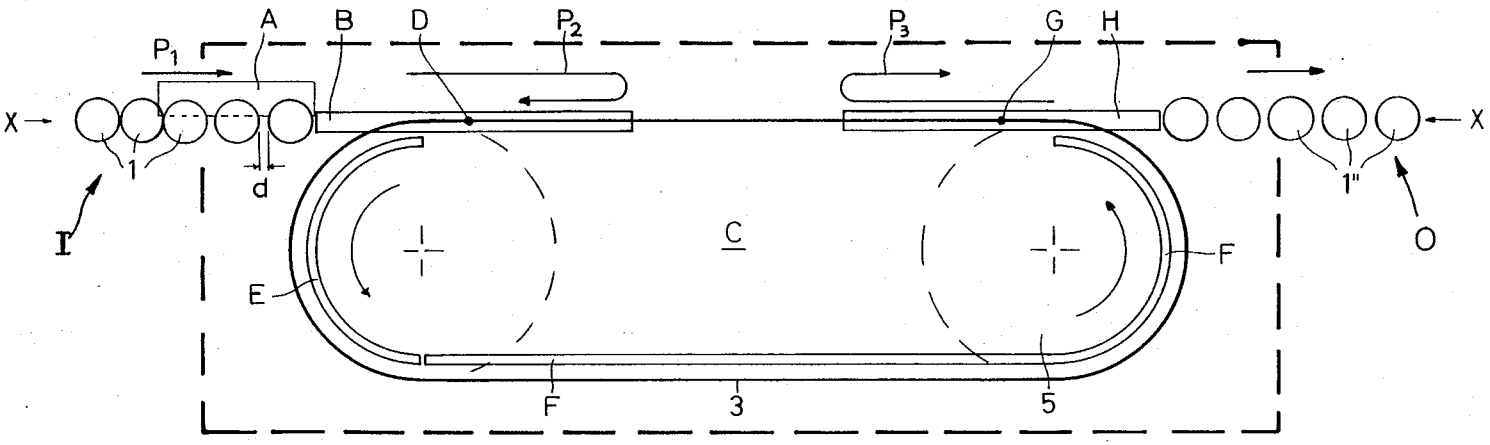
FIG. 1 is a schematic top view of the system according to the invention.
Figure 2:
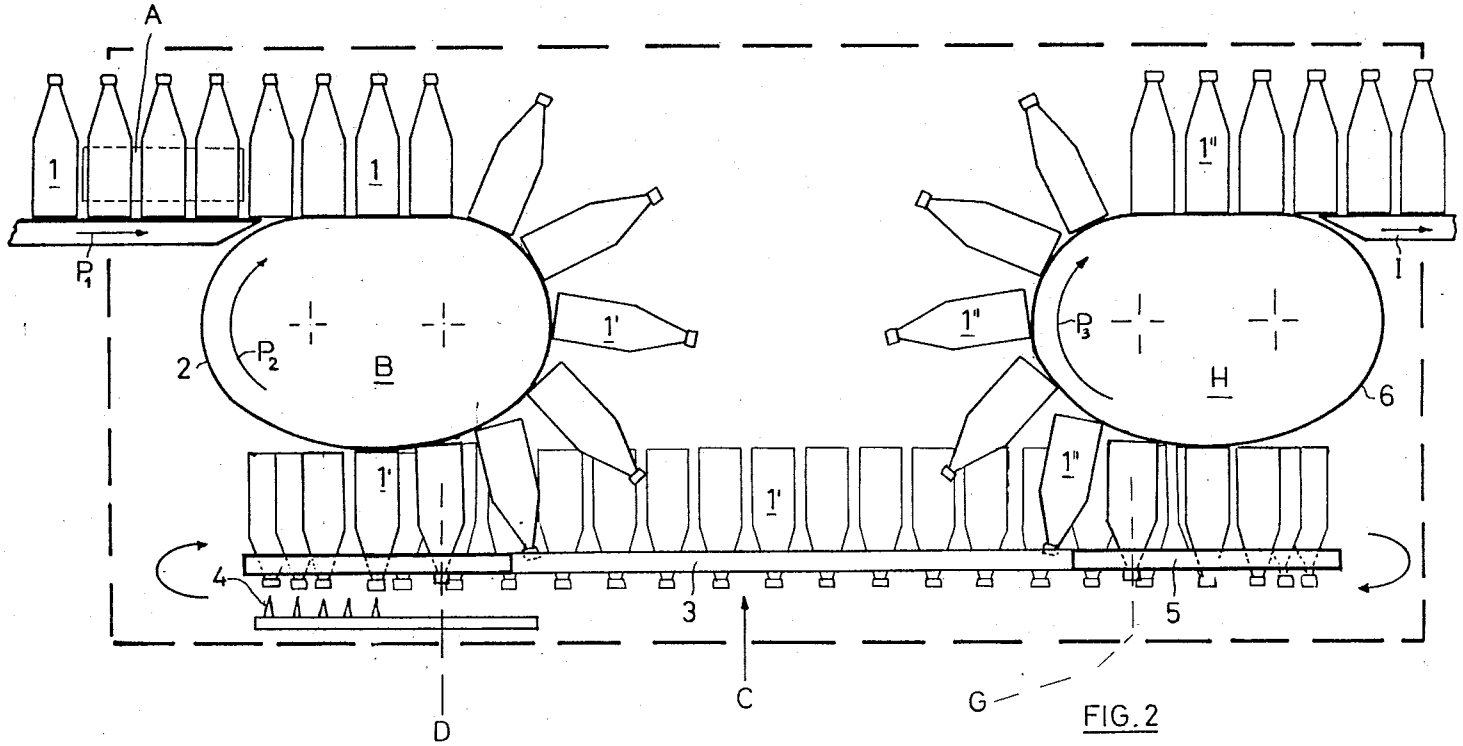
FIG. 2 is a schematic elevation view of the system according to FIG. 1.

FIGS. 1 and 2 show schematically sketches of the washing apparatus according to the invention. FIG. 1 shows a view to a horizontal plane and FIG. 2 shows a view to a vertical plane.

As can be seen from FIGS. 1 and 2 the apparatus discussed herein is provided for the washing of bottles 1, which are supplied to the apparatus by a first conveyor arrangement I and are discharged from the apparatus by a second conveyor arrangement O. If necessary a distribution device A is provided at the inlet side of the apparatus in order to cause a predetermined distance "d" between the bottles 1 to be cleaned. Such conveying installations I and O as well as distribution devices A are well known to skilled persons and being not explained in detail.

Figure 3:
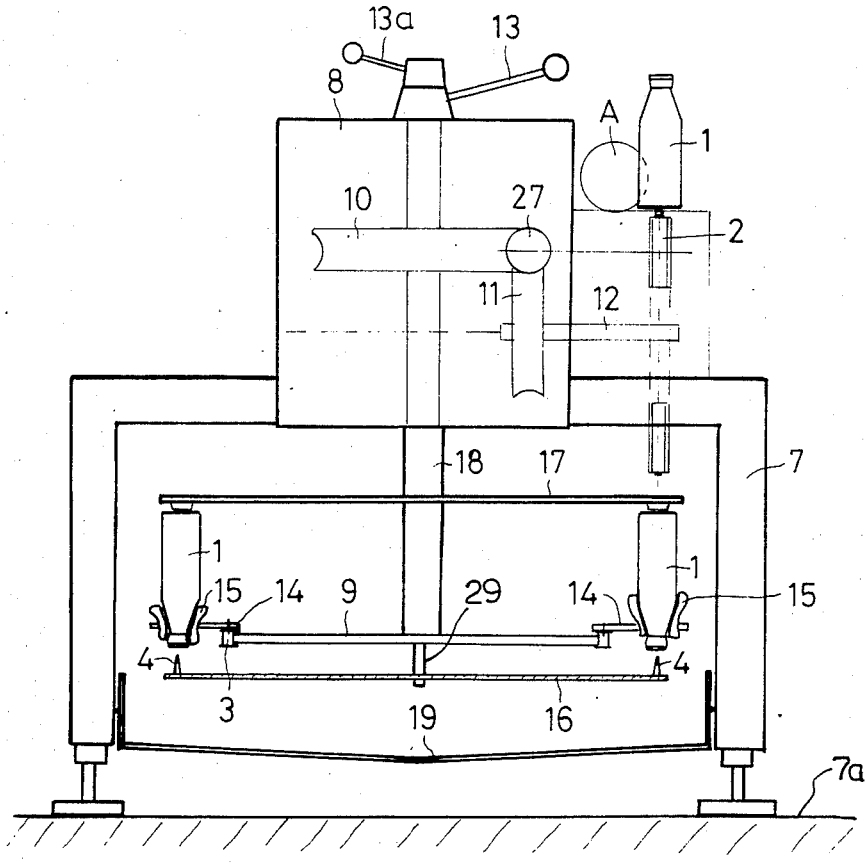
FIG. 3 is a partially sectioned front view.

As shown in FIGS. 2 and 3 the apparatus substantially includes a washing station E for rinsing the bottles 1, a transportation device C for supplying the bottles to be cleaned to the washing station E, a handling device B for picking up the bottles 1 to be cleaned from the input conveying installation I and for transfering the bottles to be cleaned to the transportation device C and a further handling device H for removing the cleaned bottles 1″ from the transportation device C and transfering the bottles 1″ to the output conveyor installation O.

The handling device B and the handling device H each include an endless conveyor 2 and 6. Each conveyor 2 and 6 may be chain like and may be provided with pick-up means known from customary bottle processing systems.

As obvious from FIG. 3 the transportation device includes a chain like conveyor 3 and two sprocket wheels 9 (only one is shown). As shown in FIG. 1 the sprocket wheels are spaced to each other such that the runway of the conveyor 3 is composed of two semicircles and two straight lines.

The handling device B and the handling device H are arranged such that the runways of their conveyors 2 and 6 extend in a common, substantially vertical plane whereas the transportation device C is arranged such that the runway of its conveyor extends in a substantially horizontal plane, wherein the line of intersection of both planes constitutes a straight line of the runway of the conveyor 3.

This results in substantial space savings by which the apparatus could be smaller in size.

It will be appreciated that the handling device B and/or the handling device H may be arranged, relative to the transportation device C, such that the planes constituted by the semicircle of their conveyors extend tangentially to the semicircle of the runway of the conveyor 3 of the transportation device C. Furthermore, the planes of the runways of the conveyors of the handling device B and handling device H may extend both along the same straight line or each along another straight line of the runway of the conveyor of the transportation means.

As shown in FIG. 3 the apparatus includes a frame 7 fixed on the floor 7*a* in known manner e.g. by anchor bolts. A drive unit 8 for driving at least the handling device B and handling device H as well as the transportation device C is mounted on the frame 7. The drive unit 8 has an electric drive motor (not shown) and a main shaft 27 coupled with the drive motor. A first wheel 10 for driving the conveyor 3 of the transportation device C on the one hand is coupled to the main shaft 27 and, on the other hand, fixed on a vertical extending tubular shaft 18. One of the sprocket wheels 9 of the conveyor 3 is mounted on the lower end of the tubular shaft 18. An adjusting means 13 is fixed on the upper end of the tubular member 18 in order to adjust the sprocket wheel 9 in vertical direction. A second wheel 11 for driving the handling device B is also in operational connection with the main shaft 27 and through a shaft 12 in operational connection with the handling device B. It will be noted that the handling device H is driven in the same manner as the handling device B.

The washing station E is disposed underneath the sprocket wheel 9 of the conveyor 3. The washing station E includes a circular plate 16 and a plurality of spraying nozzles 4. The circular plate 16 is mounted on the lower end of a rod 29. Means 13*a* for adjusting the washing station E in vertical direction are disposed at the upper end of the rod. The rod 29 and the sprocket wheel 9 are operatively connected such that the circular plate 16 rotates synchronously with the sprocket wheel 9. The spraying nozzles 4 are arranged circularly along the periphery of the plate 16. Due to the design of the washing station E and the transportation device C the spraying nozzles 4 remain below the bottle mouth during the washing operation. The washing device E will be further described in detail with regard to FIG. 6.

Furthermore a retaining wheel 17 for counterholding the bottles 1 inserted in the conveyor 3 is mounted on the tubular shaft 18 in order to retain the bottles 1 during the washing process. Finally a drain pan 19 is disposed underneath the washing station E.

The conveyor 3 includes a plurality of members 14 for supporting the bottles. Each support member 14 has a cup-shaped holder 15 for one bottle 1 and a roller 30.

Figure 4:
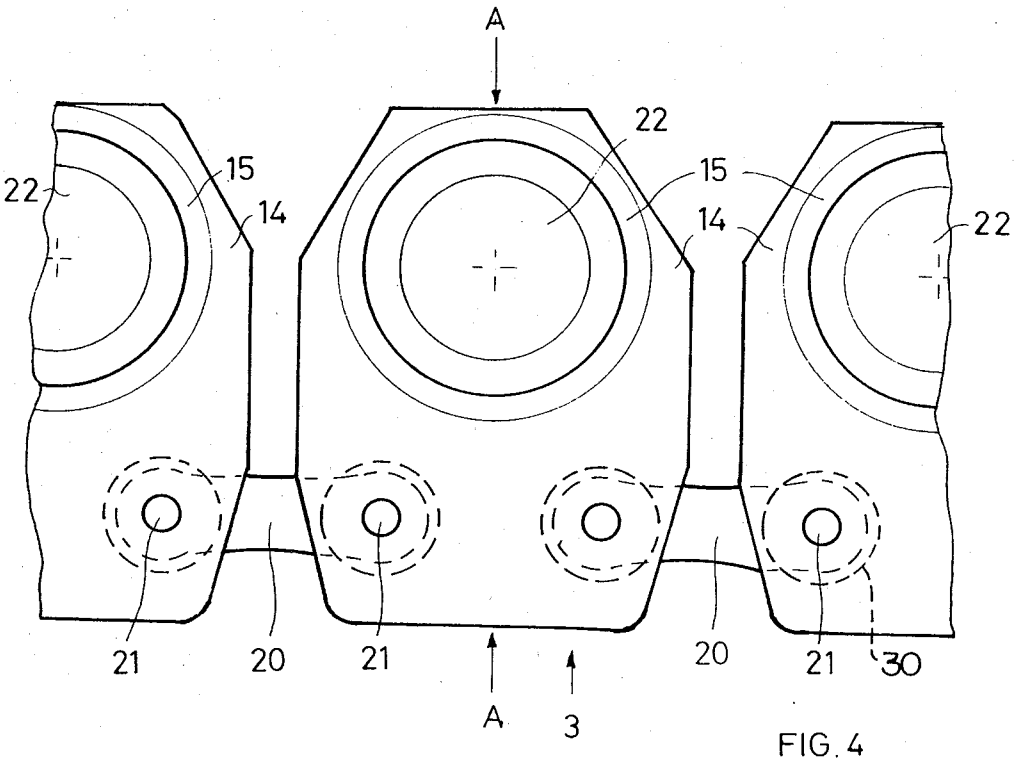
FIG. 4 is a part of the horizontal conveyor in greater scale.
Figure 5:
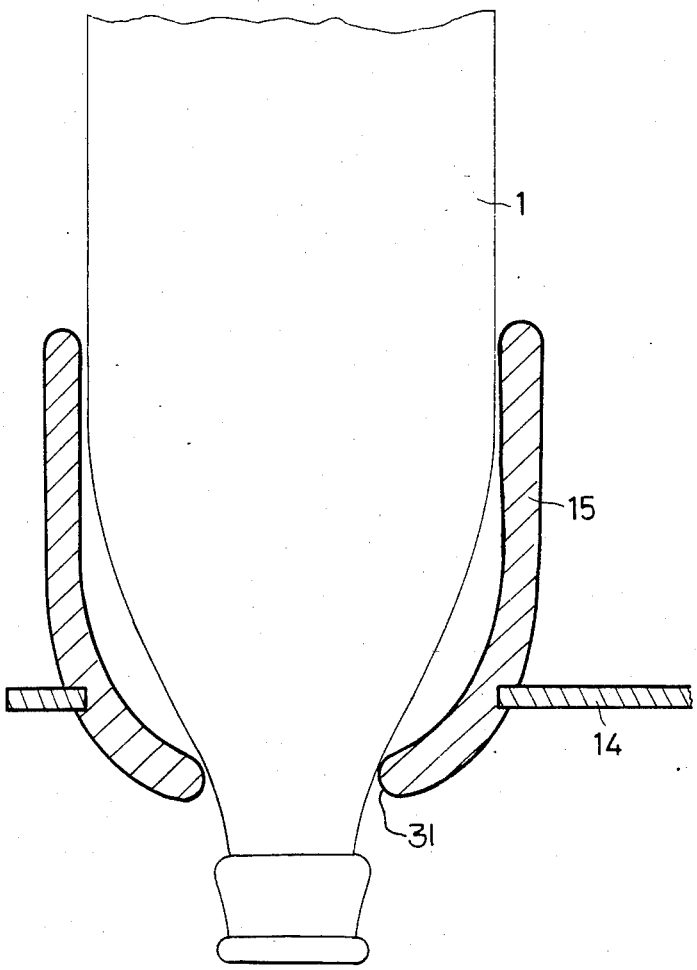
FIG. 5 is a sectional view along line A—A in FIG. 4.

FIG. 4 shows a top view of the conveyor 3 of the transportation means and FIG. 5 shows a section along line A—A in FIG. 4.

As obvious from FIG. 4 the conveyor 3 includes support members 14; links 20 connecting adjacent support member 14; rollers 30 rotably mounted on each support member 14 and cup-shaped holders 15 for each bottle 1. The support member 14 is an elongated plate whereby the cup-shaped holder 15 is fixed in the area of one short side thereof and the links 20 are pivotably mounted in the area of the opposite short side. Thus that region of the support member bearing the cup-shaped holder 15 projects outwardly from the runway of the conveyor 2 (FIG. 3). The cup-shaped holder 15 has a through-hole 31 in the center of it's bottom such that one bottle 1 having the bottle mouth downwardly directed can be inserted autocentering. The cup-shaped holder 15 is fixed in a hole 22 provided in the plate 15 (FIG. 5).

The links 20 are connected to the plates 14 by means of studs 21. Each plate 14 is equipped with two spaced studs 21 fixedly mounted thereon. The distance between said two studs 21 is equal to the distance of the studs 21 between two adjacent plates 14. Thus the studs 21 are located equidistantly along the entire length of the conveyor, whereby said distance is equal to the pitch of the sprocket wheel 9.

Figure 6:
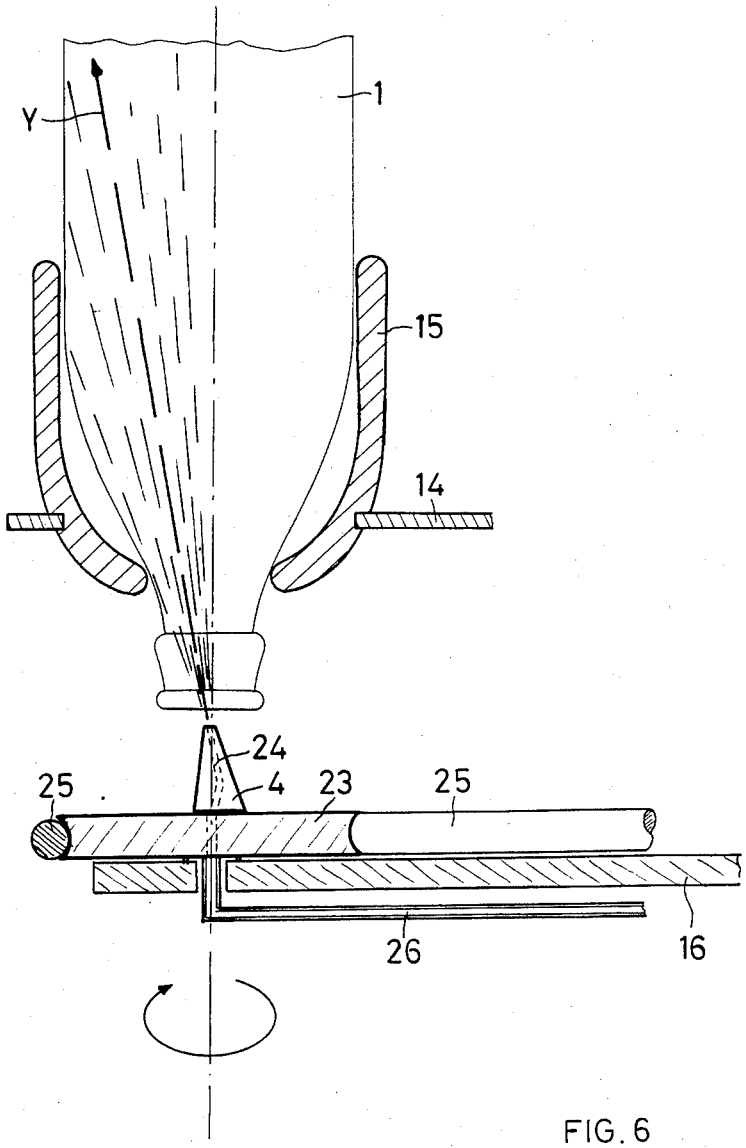
FIG. 6 is a sectional view through a part of the rinsing station.

As shown in FIG. 6 the spraying nozzle 4 is fixedly mounted on a rotary plate 23 which is rotatably mounted on the circular plate 16. Each spraying nozzle 4 has a nozzle duct 24 inclined with regard to the center of rotation of the spraying nozzle 4. In that way the liquid for rinsing is sprayed along an inclined main axis Y into the bottle 1.

A belt 25 having fixed ends surrounds all rotary plates 23 at the periphery thereof, such that a relative rotary motion of the rotary plates 23 is caused with regard to the entire system. The relative rotary motion of the circular plate 16 and the bottles 1 retained in the cup-like holders 15 with regard to the system results in a relative rotary motion of the spraying nozzles 4 with regard to the bottles 1. In that way the main liquid jet sweeps over the entire inner surface of the bottle to be washed. Finally, the rinsing liquid is supplied by a tube 26 connected to the spraying nozzles 4 and to a source of liquid.

The washing apparatus operates as follows:

As obvious from FIGS. 1 and 2 bottles 1 to be rinsed are supplied in one line by means of the input conveyor I. The distribution device A provides a predetermined distance "d" between bottles 1 before they enter the washing apparatus.

The bottles 1 are picked-up from the input conveyor I by means of the pick-up means provided on the conveyor 2 of the first handling device B. The conveyor 2 travels in the direction of the arrow P2. During moving the bottles 1' are retained by the pick-up means and are pivoted about 180 degrees such that the bottle mouth is directed downwardly. The bottles 1' are transferred to the conveyor 3 of the transportation device C as soon as they have reached the lowest point D of the runway of the conveyor 3. At this point D the bottles 1' are released by the pick-up members and drop into the cup-shaped holders 15 (FIG. 5). The conveyor 3 displaces the inverted bottles 1', starting at point D, along the semicircle through the washing station E including the rinsing nozzles 4. The inverted bottles 1' are rinsed by the rinsing fluid escaping from the corresponding nozzle 4.

Upon rinsing, the bottles 1'0 are forwarded by the conveyor 3. In that way the inverted bottles 1' pass the straight line and the other semicircle of the runway of the conveyor 3. During this passage the rinsing fluid may flow out from the inverted bottle 1'. This part of the runway constitutes a draining station indicated with F.

The cleaned bottle 1 is grasped from the picking-up member of the conveyor 6 of the second handling device H, when reaching point G at the runway of the conveyor 3. The conveyor 6 travels in the direction of the arrow P3. During the displacement the bottles 1'' are retained by the pick-up members and are pivoted about 180 degrees. In that way each bottle 1'' is placed upright on to the output conveyor. Finally the cleaned bottles 1'' may be removed from the apparatus and supplied to further systems, e.g. to a filling plant.

What is claimed is:

1. A washing apparatus for cleaning containers open at one end thereof, particularly for cleaning bottles, said apparatus comprising:

first conveyor means for continuously feeding said containers to be cleaned in an upright orientation and in a sequence along a first path;

first handling means for receiving said containers from said first conveyor means and moving said containers along a second path while transferring said containers from the upright orientation to an inverted orientation;

transportation means for receiving said containers from said first handling means in said inverted orientation and moving said containers along a third path extending in a substantially horizonal plane;

said transportation means comprising a plurality of container support members for receiving and supporting said containers, said container support members being movable by said transportation means in sequence along said third path;

said third path comprising first and second curved portions and at least one substantially straight portion extending between said first and second curved portions, both ends of the third path being located in the region between two opposite ends of said first and second curved portions and defining a container receiving location and a container delivery location, said first handling means being located in the region of the container receiving location of said third path;

rinsing means disposed beneath said first portion of said third path and comprising an array of nozzles synchronously movable with said transportation means to spray a cleansing fluid upwardly into openings of said inverted containers received in said container supporting members and traveling above said array of nozzles along said first curved portion of said third path;

there being provided rotary bearing and drive means for establishing a relative rotational movement between each of said container support members and the corresponding nozzle the axis of said relative rotational movement being directed substantially at right angles to said plane of the third path;

second handling means located in the region of the container delivery position for taking up and moving inverted cleaned containers along a fourth path while transferring said containers from the inverted orientation to the upright orientation;

second conveyor means for receiving said upright oriented containers from said second handling means and moving said upright containers away along a fifth path;

said second and fourth path extending each in a substantially vertical plane and each comprising at least partially curved portion for effecting transfer of said containers from the upright orientation to the inverted orientation and from the inverted orientation to the upright orientation, respectively.

2. The apparatus as set forth in claim 1 wherein said rinsing means comprises nozzle support means for supporting said array of rinsing nozzles located beneath said first curved portion of said third path and moving concentrically therewith the circumferential spacing of said rinsing nozzles corresponding to the circumferential spacing of said container support members on said first curved portion, and means for moving said circular plate synchronously with movement of said transportation means.

3. The apparatus according to claim 2 wherein said nozzle support means comprises a plurality of rotary carrier devices rotatably mounted on said nozzle support means, each rotary carrier device carrying at least one of said spraying nozzles, the output direction of each of said nozzles being at an angle to the axis of rotation of the rotary carrier device upon which it is carried.

4. A washing apparatus for cleaning containers open at one end thereof, particularly for cleaning bottles, said apparatus comprising:

first conveyor means for continuously feeding said containers to be cleaned in an upright orientation and in a sequence along a first path;

first handling means for receiving said containers from said first conveyor means and moving said containers along a second path while transferring said containers from the upright orientation to an inverted orientation;

transportation means for receiving said containers from said first handling means in said inverted orientation and moving said containers along a third path extending in a substantially horizontal plane;

said transportation means comprising a plurality of container support members for receiving and supporting said containers, said container support members being movable by said transportation means in sequence along said third path;

said third path comprising first and second curved portions and at least one substantially straight portion extending between said first and second curved portions, both ends of the third path being located in the region between two opposite ends of said first and second curved portions and defining a container receiving location and a container delivery location, said first handling means being located in the region of the container receiving location of said third path;

rinsing means disposed beneath said first portion of said third path and comprising an array of nozzles synchronously movable with said transportation means to spray a cleansing fluid upwardly into openings of said inverted containers received in said container supporting members and traveling above said array of nozzles along said first curved portion of said third path;

there being provided rotary bearing and drive means for establishing a relative rotational movement between each of said container support members and the corresponding nozzle, the axis of said relative rotational movement being directed substantially at right angles to said plane of the third path;

second handling means located in the region of the container delivery position for taking up and moving inverted cleaned containers along a fourth path while transferring said containers from the inverted orientation to the upright orientation;

second conveyor means for receiving said upright oriented containers from said second handling means and moving said upright containers away along a fifth path;

said second and fourth path extending each in a substantially vertical plane and each comprising at least partially curved portion for effecting transfer of said containers from the upright orientation to the inverted orientation and from the inverted orientation to the upright orientation, respectively, said third path extending tangentially to said second and fourth paths.

5. A washing apparatus for cleaning containers open at one end thereof, particularly for cleaning bottles, said apparatus comprising:

first conveyor means for continuously feeding said containers to be cleaned in an upright orientation and in a sequence along a first path;

first handling means for receiving said containers from said first conveyor means and moving said containers along a second path while transferring said containers from the upright orientation to an inverted orientation;

transportation means for receiving said containers from said first handling means in said inverted orientation and moving said containers along a third path extending in a substantially horizontal plane;

said transportation means comprising a plurality of container support members for receiving and supporting said containers, said container support members being movable by said transportation means in sequence along said third path; said third path comprising first and second curved portions and at least one substantially straight portion extending between said first and second curved portions, both ends of the third path being located in the region between two opposite ends of said first and second curved portions and defining a container receiving location and a container delivery location, said first handling means being located in the region of the container receiving location of said third path;

rinsing means disposed beneath said first portion of said third path and comprising an array of nozzles synchronously movable with said transportation means to spray a cleansing fluid upwardly into openings of said inverted containers received in said container supporting members and traveling above said array of nozzles along said first curved portion of said third path;

said rinsing means comprising nozzle support means for supporting said array of rinsing nozzles located beneath said first curved portion of said third path and moving concentrically therewith, the circumferential spacing of said rinsing nozzles corresponding to circumferential spacing of said container support members on said first curved portion, and means for moving said circular plate synchronously with movement of said transportation means;

said nozzle support means comprising a plurality of rotary carrier devices rotatably mounted on said nozzle support means, each rotary carrier device carrying at least one of said spraying nozzles, the output direction of each of said nozzles being at an angle to the axis of rotation of the rotary carrier device upon which it is carried;

there being provided rotary bearing and drive means for establishing a rotational movement between each of said container support members and the corresponding nozzle the axis of said relative rotational movement being directed substantially at right angles to said plane of the third path;

second handling means located in the region of the container delivery position for taking up and moving inverted cleaned containers along a fourth path while transferring said containers from the inverted orientation to the upright orientation;

second conveyor means for receiving said upright oriented containers from said second handling means and moving said upright containers away along a fifth path;

said second and fourth path extending each in a substantially vertical plane and each comprising at leat partially curved portion for effecting transfer of said containers from the upright orientation to the inverted orientation and from the inverted orientation to the upright orientation, respectively.

6. The apparatus according to claim 5, wherein said first and said second handling means are endless chain conveyors, the chains thereof travelling essentially in a vertical plane, and whereby a plurality of container pick-up and clamping means are mounted to said chains.

7. The apparatus according to claim 5, comprising a rinsing station for containers extending along said first curved portion of said third path as well as a draining station, adjacent to said rinsing station and extending at least along one of said straight portions of said third path as well as along said second curved portion of said third path.

8. The apparatus according to claim 5, wherein said rotary plates are surrounded by a belt, the ends thereof being fixedly mounted in order to drive the rotary plates to a relative rotational movement with reference to said circular plate upon rotation thereof.

* * * * *